US009156080B2

(12) United States Patent
Yuki et al.

(10) Patent No.: US 9,156,080 B2
(45) Date of Patent: Oct. 13, 2015

(54) CASTING DIE

(71) Applicant: HONDA MOTOR CO., LTD., Tokyo (JP)

(72) Inventors: Kenji Yuki, Tochigi (JP); Takefumi Yokoyama, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/340,772

(22) Filed: Jul. 25, 2014

(65) Prior Publication Data

US 2015/0027655 A1 Jan. 29, 2015

(30) Foreign Application Priority Data

Jul. 25, 2013 (JP) ..... 2013-154907
Jul. 25, 2013 (JP) ..... 2013-154908

(51) Int. Cl.
*B22C 9/18* (2006.01)
*B22C 1/02* (2006.01)
*B22D 17/22* (2006.01)

(52) U.S. Cl.
CPC .... *B22C 9/18* (2013.01); *B22C 1/02* (2013.01)

(58) Field of Classification Search
CPC ..... B22C 9/18; B22C 1/02; B22D 17/22; B22D 17/2209
USPC ..... 164/271, 284, 267; 249/114.1, 115
See application file for complete search history.

(56) References Cited

U.S. PATENT DOCUMENTS

| | | | | |
|---|---|---|---|---|
| 8,256,493 | B2 * | 9/2012 | Furukawa et al. | 164/267 |
| 8,413,708 | B2 | 4/2013 | Furukawa et al. | |
| 8,424,588 | B2 | 4/2013 | Hirano et al. | |
| 2009/0277884 | A1 | 11/2009 | Uno et al. | |

FOREIGN PATENT DOCUMENTS

| | | |
|---|---|---|
| JP | 63-256251 | 10/1988 |
| JP | 2009-226479 | 10/2009 |
| JP | 4694358 | 3/2011 |

(Continued)

OTHER PUBLICATIONS

Japanese Office Action with English translation, dated May 12, 2015, 6 pages.

(Continued)

*Primary Examiner* — Kevin P Kerns
(74) *Attorney, Agent, or Firm* — Rankin, Hill & Clark LLP

(57) ABSTRACT

A casting die applied with laser machining and carbon-film coating on a die surface is provided with multiple grooves formed spaced at a predetermined pitch by the laser machining; multiple ridges between the multiple grooves; and multiple carbon portions buried in the multiple grooves by the carbon-film coating, wherein the die surface with the ridge and the carbon portion alternately disposed is configured such that molten metal flows thereon; the grooves are 45 μm or less in opening width and 60 μm or more in depth; and the ridge has, on a top surface thereof applied with the laser machining, multiple micro-grooves for reducing a contact area with the molten metal. The casting die is aimed to balance expanding the groove width and increasing a thickness of the carbon film and to achieve suppression of the molten metal entering into the groove and exfoliation of the carbon film.

2 Claims, 14 Drawing Sheets

(56) References Cited

FOREIGN PATENT DOCUMENTS

| | | |
|---|---|---|
| JP | 4775521 | 7/2011 |
| JP | 5036656 | 7/2012 |
| WO | 2010/104032 | 9/2010 |
| WO | 2011/123205 | 10/2011 |
| WO | 2013/084323 | 6/2013 |

OTHER PUBLICATIONS

Japanese Office Action dated Dec. 2, 2014, Application 2013-154907, English translation included.

* cited by examiner

FIG. 5

| Depth (μm) \ Opening Width (μm) | 25 | 35 | 45 | 55 | 60 | 70 |
|---|---|---|---|---|---|---|
| 40 | NA | NA | NA | NA | Peeled Sample 17 | Peeled Sample 24 |
| 50 | NA | NA | NA | NA | Peeled Sample 18 | Peeled Sample 25 |
| 60 | Buried Sample 1 | NA | NA | NA | Peeled Sample 19 | Peeled Sample 26 |
| 70 | Buried Sample 2 | Buried Sample 6 | Buried Sample 10 | NA | Peeled Sample 20 | Peeled Sample 27 |
| 80 | Buried Sample 3 | Buried Sample 7 | Buried Sample 11 | Peeled Sample 14 | Peeled Sample 21 | Peeled Sample 28 |
| 90 | Buried Sample 4 | Buried Sample 8 | Buried Sample 12 | Peeled Sample 15 | Peeled Sample 22 | Peeled Sample 29 |
| 100 | Buried Sample 5 | Buried Sample 9 | Buried Sample 13 | Peeled Sample 16 | Peeled Sample 23 | Peeled Sample 30 |

□ : Width of entire groove formed by lens 1 (F = 163mm)

■ : Width of entire groove formed by lens 2 (F = 255mm)

△ : Width of convex portion formed by lens 1

▲ : Width of convex portion formed by lens 2

CASTING DIE

CROSS REFERENCE TO RELATED APPLICATIONS

The present application relates to and claims priority from Japanese Patent Application No. 2013-154907 filed on Jul. 25, 2013 and Japanese Patent Application No. 2013-154908 filed on Jul. 25, 2013. The entirety of the contents and subject matters of all of the above applications is incorporated herein by reference.

BACKGROUND OF THE INVENTION

1. Field of the Invention

The present invention relates to a casting die.

2. Description of Related Art

Conventionally, in order to produce high quality castings by suppressing an occurrence of casting defects such as flow lines and cold shuts, casting dies applied with surface-machining or surface-treatment have been developed.

For example, the following Patent Literature 1 and 2 disclose a casting die whose surface is formed with grooves or dimples, in order to ensure a space (air gap) into which residual gas in a cavity can enter.

Further, the following Patent Literatures 3 and 4, in order to increase a contact angle of molten metal, disclose a casting die whose surface is coated with a carbon film including a nano-carbon.

PATENT LITERATURE

Patent Literature 1: Japanese Laid-Open Patent Publication No. S63-256251

Patent Literature 2: Japanese Patent No. 4775521

Patent Literature 3: Japanese Patent No. 4694358

Patent Literature 4: Japanese Patent No. 5036656

SUMMARY OF THE INVENTION

Problems to be Solved

Here, relating to a technique of forming a groove on the die surface, there is a problem that enlargement of a width of the groove makes it easy for the molten metal to enter the groove, although the enlargement of the groove width is desirable because of being able to expand the air gap to reduce a contact area between the die and the molten metal.

Additionally, relating to a technique of coating the carbon film on the die surface, there is another problem that forming a thick carbon film makes it easy for thermal load to cause peeling and lacking of the carbon film, although the thick carbon film is desirable because of improvement of heat-insulating performance.

Accordingly, in view of the problems described above, an object of the present invention is to provide a casting die that can prevent the molten metal from entering the groove and to suppress the exfoliation of the carbon film by combining techniques of forming grooves and coating on the die surface.

Solutions to the Problems

In order to solve the above problems, the present invention discloses a casting die applied with a laser machining and a coating of a carbon film on a die surface, and the casting die is provided with a plurality of grooves formed at a predetermined pitch by a first laser machining, a plurality of ridges protruding between the plurality of grooves, and a plurality of carbon portions buried in the plurality of grooves by the coating of the carbon film, wherein molten metal flows on the die surface having the ridge and the carbon portion alternately disposed; the groove has an opening width of 45 μm or less and a depth of 60 μm or more; and the ridge has, on a top surface thereof, a plurality of micro-grooves for reducing a contact area with the molten metal, and the plurality of micro-grooves are applied with a second laser machining.

In the invention described above, the carbon film coated on the die surface becomes a carbon portion buried in the groove that has an opening width of 45 μm or less and a depth of 60 μm or more and is difficult to peel even if casting pressure acts thereon.

Further, the carbon portion buried in the groove works as a heat-insulating member and suppresses the molten metal from entering the groove, because the carbon portion has a thickness of 60 μm or more that is almost equal to the depth of the groove.

Furthermore, the casting die formed with a plurality of relatively large grooves having an opening width of 45 μm or less enables to reduce a contact area between the molten metal and the die surface, and to suppress heat dissipation of the molten metal to improve fluidity of the molten metal.

Additionally, the invention described above can further improve the thermal insulation capability by the air gap formed also on the top surface of the ridge because the micro-grooves are formed on the top surface of the ridge contacting with the molten metal.

A pitch between the grooves is preferably 100 μm or less.

The configuration described above increases the ratio of the carbon portions than the ridges per unit length along a flow path of the molten metal and improves the heat insulation.

Effect of the Invention

The present invention is invented by combining the technique for forming grooves and that for coating the die surface, and provides a casting die that is able to prevent the molten metal from entering the grooves and to suppress the peeling of the coating.

BRIEF DESCRIPTION OF THE DRAWINGS

FIG. 2A shows the surface of the movable die shown in FIG. 1; and FIGS. 2B to 2F show the surface of modifications in which the grooves extend in different directions.

FIG. 5 is a diagram showing depths and aperture-widths of Samples 1-13 of Embodiment 1 and Samples 14 to 30 of the comparative examples.

FIG. 6A shows a cross section of Sample 1; and FIG. 6B shows a cross section of Sample 6.

FIG. 7A shows a cross section of Sample 14; and FIG. 7B shows a cross section of Sample 17.

DETAILED DESCRIPTION OF THE INVENTION

Next, a description is made of embodiments of the present invention.

The casting die includes a movable die 1 and a stationary die that form a cavity by die matching, and is used for producing castings with the same shapes as the cavity by pressing molten metal into the cavity.

Further, regarding the surface structure of the casting die according to the present embodiment, the laser machining and the carbon-film coating are applied on the surface of the movable die 1 and the stationary die. Now, using a movable die 1, explanation is made of the surface structure of the movable die 1 and the stationary die.

Figure 1:
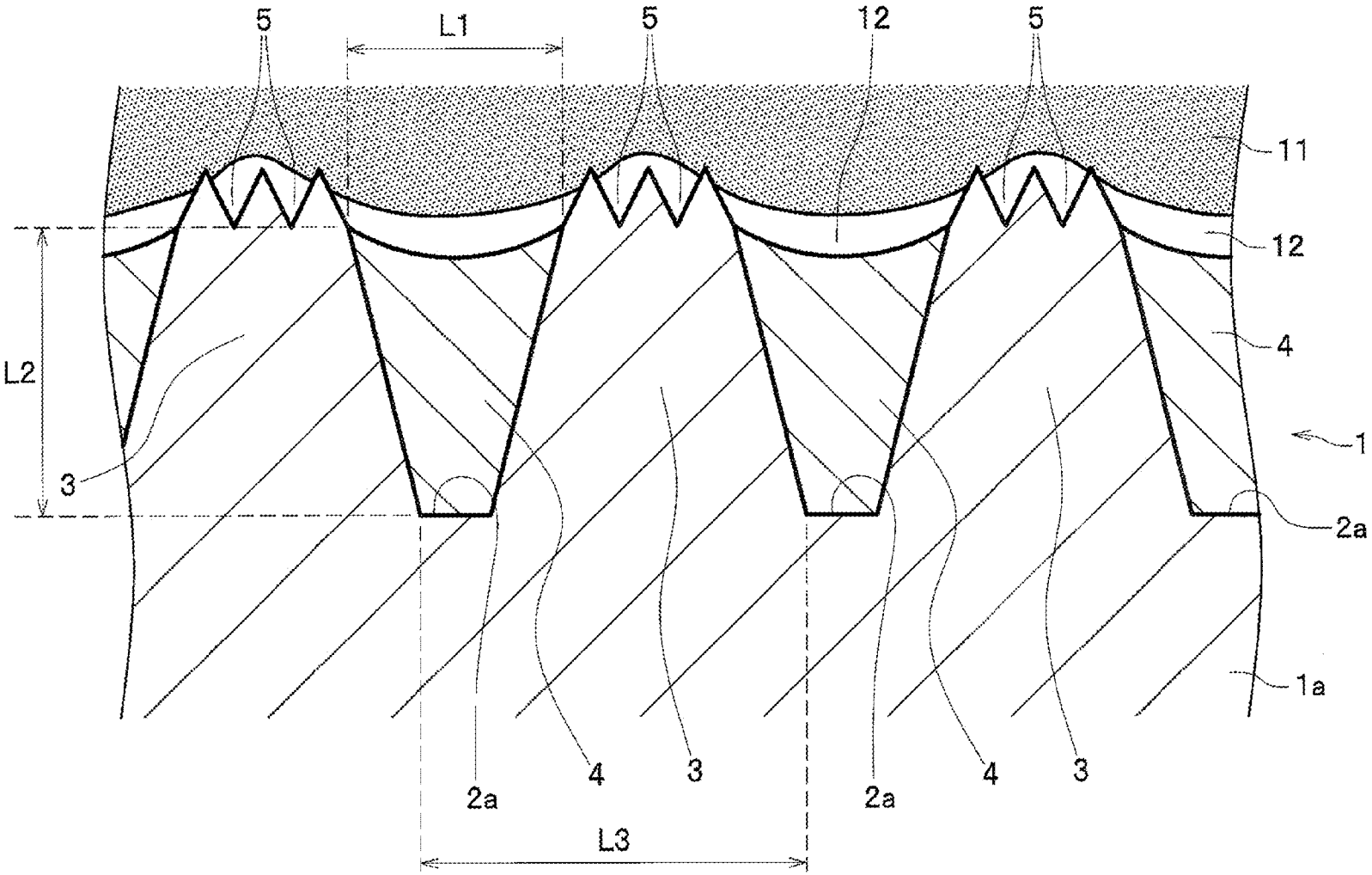
FIG. 1 is an enlarged cross sectional view of a cross section of a movable die of a casting die according to an embodiment.

As shown in FIG. 1, the movable die 1 is provided with a plurality of the grooves 2 (the same as the reference number 4) formed by laser machining, a plurality of ridges 3 formed between the plurality of the grooves 2, and a plurality of carbon portions 4 buried in the plurality of the grooves 2, on the surface of the movable die 1 on which the molten metal 11 flows through.

SKD material (dies steel) such as SKD 11 and SKD 61 is used for the die material 1*a* forming the movable die 1.

The groove 2 is a space formed by irradiating a pulse laser beam of a width of 10 psec or less on a surface of the die material 1*a* and by an ablation process (non-thermal process).

Since the pulse laser beams irradiated on the die material 1*a* converge along with proceeding in the depth direction of the die member 1*a*, the shape of the groove 2 is like a trapezoid that has a width of the bottom side thereof narrower than an opening width of the top side thereof. The groove 2 has a size of the opening width L1 of at least 45 μm or less and the depth L2 of at least 60 μm or more, in order to prevent the carbon portion 4 buried in the groove 2 from being peeled. In addition, a groove surface 2*a* to which the carbon portion 4 closely adheres is rough in order to obtain strong adhesion of the carbon portion 4.

Figure 2A:
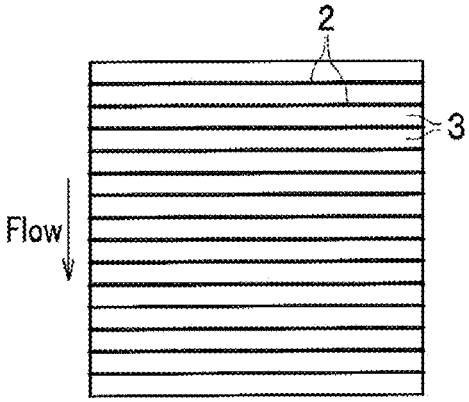
FIGS. 2A to 2F are enlarged plan views of a portion of a groove and a ridge formed on a surface of the movable die.

As shown in FIG. 2A, the groove 2 extends such that the groove 2 intersects perpendicularly with the direction in which the molten metal flows on the surface of the die material 1*a*, and a plurality of the grooves 2 are parallel to each other.

Additionally, the plurality of the grooves 2 are arranged at a predetermined pitch L3 in the direction of the flow of the molten metal (refer to FIG. 1). Note that the predetermined pitch L3 is preferably 100 μm or less. This distance L3 enables to increase the ratio of the carbon portions 4 to the ridges 3 per unit length in the direction of the flow of the molten metal to improve the thermal insulation capability.

It should be understood that the present invention does not limit the extending direction of the plurality of the grooves 2 to the special direction.

Figure 2B:
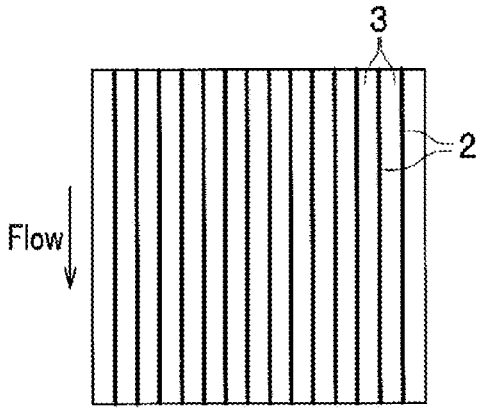
Figure 2C:
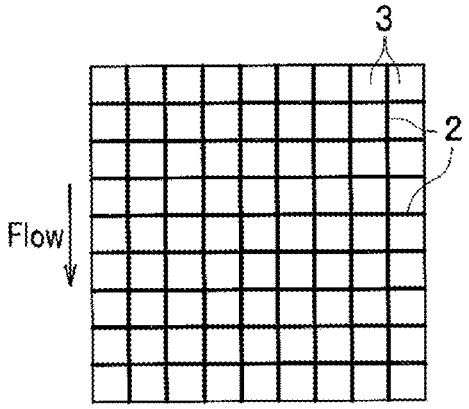
Figure 2D:
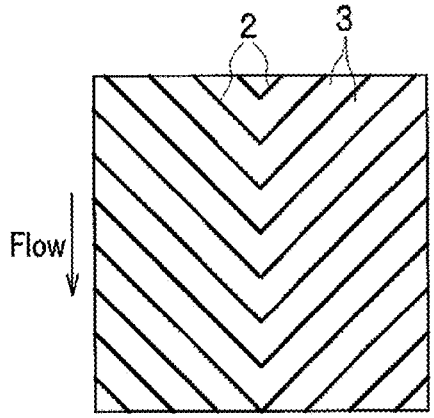
Figure 2E:
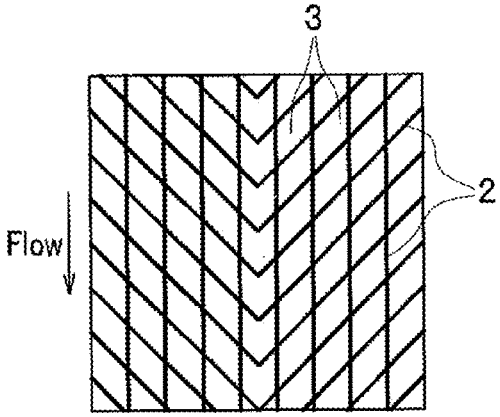
Figure 2F:
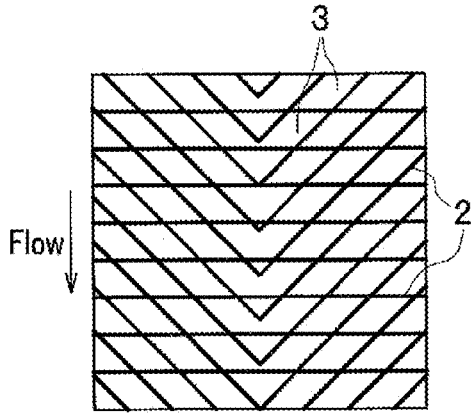

For example, the plurality of the grooves 2 may be the grooves 2 parallel to the flow of the molten metal (refer to FIG. 2B), a combination of the grooves 2 orthogonal and parallel to the flow of the molten metal (refer to FIG. 2C), a herringbone type of groove 2 (refer to FIG. 2D), a combination of the herringbone type of groove 2 and the groove 2 parallel to the flow of the molten metal (refer to FIG. 2E), or a combination of the herringbone type of groove 2 and the groove 2 orthogonal to the flow of the molten metal (refer to FIG. 2F).

As shown in FIG. 1, a ridge 3 is a surface portion of the die material 1*a* remaining without being irradiated with the pulse laser beams in forming the plurality of the grooves 2, and has a shape like a trapezoid having the width of the top surface narrower than that of the bottom when the ridge 3 is viewed in the cross section.

Further, the top surface of the ridge 3 has micro-grooves 5 formed by irradiation of a pulse laser beam. The micro-groove 5 is a space for forming an air gap 12 by retaining the gas in the cavity. Thus, the micro-groove 5 has a size such that the molten metal 11 does not enter therein, for example, the opening width of 10 μm and the depth of 10 μm.

It should be understood that the micro-groove 5 of the present invention is not limited to the example shown in the embodiment because the micro-groove 5 may be only a groove that is being able to retain the gas in the cavity, although the micro-groove 5 in the embodiment has the opening width of 10 μm and the depth of 10 μm.

The carbon portion 4 is a carbon film buried in the groove 2 by applying carbon film complex nitriding, i.e., a kind of coating process, on the surface of the die material 1*a* with the grooves 2 and the micro-grooves 5 formed by the laser machining. Here, the carbon film complex nitriding is a complex process for forming the carbon film on the cavity surface while nitriding and forms the carbon portion 4 having a strong adhesion to the groove surface 2*a*.

The carbon portion 4 obtained by the carbon film complex nitriding enables to increase a contact angle of the molten metal 11 to improve the fluidity of the molten metal 11.

Further, the carbon portion 4 obtained by the carbon film complex nitriding becomes porous such that the inner portion thereof has a large number of micropores formed. Therefore, since the porous carbon portions 4 with lower thermal conductivity than the SKD material forming the die material 1*a* are arranged at intervals on the surface of the movable die 1 and the stationary die with which the molten metal 11 contacts, the thermal insulation capability of the movable die 1 and the stationary die can be improved. Note that using the Super Multi Knight process (made by NIHON TECHNO Co., LTD.) enables to form the porous carbon portion 4.

Furthermore, since the carbon portion 4 is buried in the groove 2 such that a thickness thereof is almost equal to the depth of the groove 2 and relatively large, the carbon portion 4 has higher thermal insulation capability.

The top surface of the carbon portion 4 is depressed deeper than the top surface of the ridge 3, thus the surface of the movable die 1 becomes an uneven surface on which grooves and ridges continuously repeat. Thereby, the gas in the cavity can be retained in the concave portions of the uneven surface, that is, the air gaps 12 are formed so as to cover the top surface of the carbon portion 4 and to improve the thermal insulation capability.

It is necessary to perform the carbon film complex nitriding on the surface of the die material 1*a* in order to form the carbon portion 4. This carbon film complex nitriding may form a carbon film covering the top surface of the ridge 3 as well as the carbon film in the groove 2 (carbon portion 4).

In this case, since the carbon film is higher in the thermal insulation capability than the die material 1*a*, the carbon film covering the top surface of the ridge 3 can be left as is. Since the carbon film covering the top surface of the ridge 3 is so easily peeled, there is a high possibility of the carbon film covering the top surface of the ridge 3 being peeled off in a testing shot even if left as is.

Further, since the top side of the carbon portion 4 is also so easily peeled that the top side of the carbon portion 4 may be peeled by a testing shot to become more depressed than the top surface of the ridge 3.

Next, a description is given of a method of forming the grooves 2 and the micro-grooves 5 by irradiating a pulse laser beam on the die material 1*a*. It should be appreciated that the present invention does not limit the method of forming the grooves 2 and the micro-grooves 5 to the method described below. The problems in the conventional laser machining are described as follows.

First, the pulse width and the pulse fluence of the conventional laser machining is relatively so large as to tend to generate a molten portion in which compressive-stress is released on a surroundings of a pulse laser irradiating area (hereinafter, refer to "outside of irradiation area") and a crack on the surface of the casting die. Further, the conventional laser machining is so low in the pulse lap ratio of the pulse laser beams that the number of scanning of the die surface is increased, thus inefficient.

Therefore, the grooves 2 and the micro-grooves 5 are preferably formed by the method described below.

The method for forming the grooves 2 and the micro-grooves 5 uses a pulse laser device equipped with a laser oscillator that is able to oscillate a pulse laser beam of a pulse width of 10 psec or less.

The pulse laser beam of a pulse width of 10 psec or less could perform the ablation processing (non-thermal processing) of the die material 1*a* because the pulse width of 10 psec is shorter than a collision relaxation time of metal elements forming the die material 1*a*. Thereby, there would be less possibility of generation of the molten portion with released compressive-stress on the outside of irradiation area and the crack on the surface of the casting die.

The method for forming the grooves 2 and the micro-grooves 5 includes an irradiation step of irradiating a pulse laser beam on the surface of the die material 1*a* while scanning thereon, and repeating multiple times of the irradiation step forms the grooves 2 and the micro-grooves 5 of respectively predetermined depths.

Figure 3:
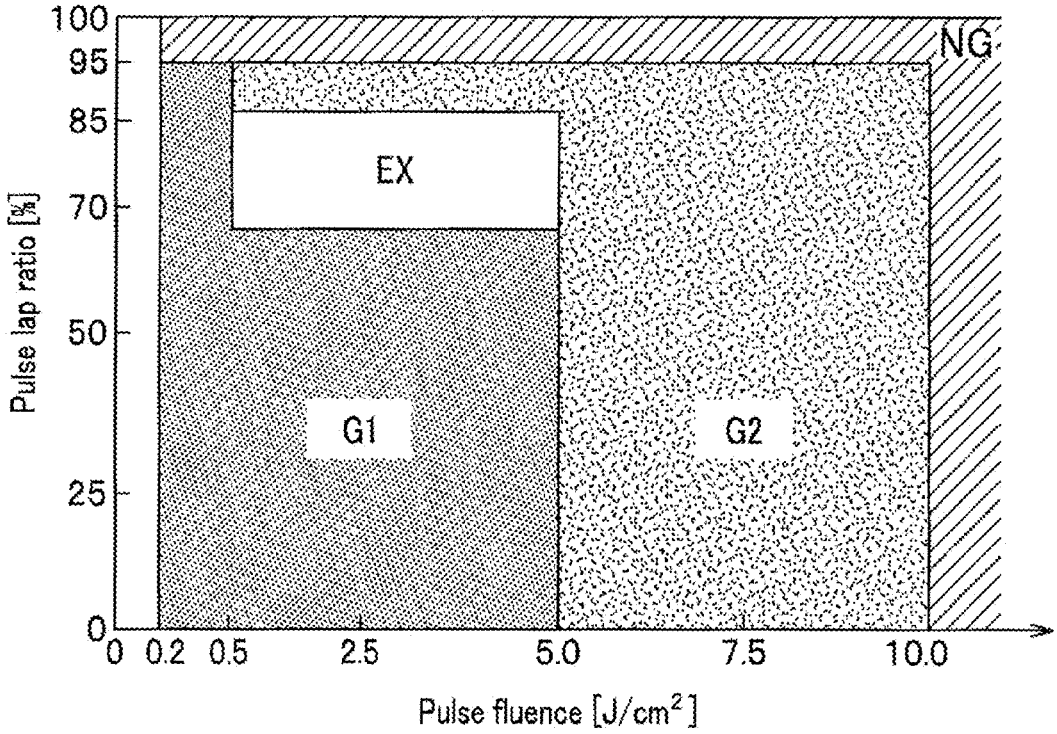
FIG. 3 is a diagram showing a relationship between pulse fluence and pulse lap ratio in an irradiation process of the embodiment.

Irradiation conditions of the pulse laser in the irradiation process is that the pulse fluence is within the range of 0.2 to 10 J/cm$^2$ and the pulse lap ratio is 95% or less (refer to the area corresponding to the ranges indicated by "EX", "G1", and "G2" in FIG. 3).

The above irradiation conditions can suppress a thermal diffusion to the outside of irradiation area of the pulse laser. Therefore, the deeper groove can be formed while suppressing the generation of the molten portion, and the reduction in the number of scanning of the surface of the die material 1*a* can be achieved.

Note that the pulse lap ratio relates to the irradiation area of the pulse laser beam irradiated intermittently in the scanning direction and means a percentage in which the irradiation area of a preceding pulse laser beam is overlapped by the irradiation area of the succeeding pulse laser beam. Therefore, the case in which the pulse lap ratio is 50% refers to that 50% of the irradiation area by the preceding pulse laser beam is overlapped with the irradiation area by the succeeding laser pulse beam.

The larger value selected for the pulse fluence can form the deeper groove on the die material 1*a* within the range of 0.2 to 10 J/cm$^2$. Note that the minimum value of the pulse fluence (0.2 J/cm$^2$) is the minimum energy required to ablate the elements of the die material 1*a*.

The larger value selected for the pulse lap ratio can increase the overlapped area of the irradiation area within the range of 95% or less and form the deeper groove.

The more preferred irradiation condition of the pulse laser beam is within the range of 0.5 to 5.0 J/cm$^2$ of the pulse fluence and the range of 70 to 85% of the pulse lap ratio (the range indicated by "EX" in FIG. 3).

With this condition, the groove formed by one scanning becomes deeper and the number of times of scanning the surface of the casting die can be reduced.

In addition, in the case of the pulse fluence of 0.2 to 5.0 J/cm$^2$ and the pulse lap ratio of 70% or less and the case of the pulse fluence of 0.2 to 0.5 J/cm$^2$ and the pulse lap ratio of 70 to 95% or less (the range indicated by "G1" in FIG. 3), the smooth surface with the little unevenness formed on the groove surface can be formed, although the groove is shallow.

Contrastingly, in the case of the range of the pulse fluence of 5.0 to 10.0 J/cm$^2$ and the pulse lap ratio of 95% or less and the range of the pulse fluence of 0.5 to 5.0 J/cm$^2$ and the pulse lap ratio of 85 to 95%, the groove formed by one scanning can become deeper, but the groove surface is formed with the large unevenness.

Additionally, the groove formed by one irradiation step under the above conditions is 0.50 μm deep at the deepest (refer to Examples 3-2 described later).

Therefore, the predetermined depth of the groove can be obtained by performing the multiple irradiation steps under the above-described irradiation conditions of the pulse laser beam, in other words, by repeating the irradiation of the laser beam while scanning the surface of the casting die multiple times.

The width of the groove formed by the irradiation step is determined by a condensing diameter of a lens. Thus, in order to form the groove with the width equal to the condensing diameter of the lens or wider, the irradiation step is needed to be performed again by shifting the irradiation position of the pulse laser beam relatively in the direction horizontal to the die material 1*a* and perpendicular to the scanning direction (hereinafter referred to as simply "perpendicular direction") to move the axis of the pulse laser beam applied to the die material 1*a* in the perpendicular direction.

Here, if the overlapping ratio of the irradiation area irradiated before moving the axis of the pulse laser beam and the irradiation area irradiated after moving the axis of the pulse laser beam (hereinafter referred to as "axial lap ratio") is less than 20%, a protruding portion in which the bottom surface of the groove becomes like a ridge is formed between the irradiation areas before and after moving the axis. Therefore, in order to make the bottom surface of the groove flat, the axial lap ratio should be more than or equal to 20%.

Note that when the carbon portion 4 covering the groove surface 2*a* is buried in the groove 2, the ridge of the groove surface 2*a* of the groove 2 enables to increase the contact area of the groove surface with the carbon portion 4. Therefore, it is possible to make the groove surface 2*a* protrude by forming the groove surface 2*a* under the irradiation condition of the axial lap ratio less than 20% to increase the adhesion of the carbon portion 4 with the groove surface 2*a*.

According to the casting die of the present embodiment described above, the carbon films coated on the movable die 1 and the stationary die become hard to peel because the carbon film becomes the carbon portion 4 buried in the groove 2 having the opening width of 45 μm or less and the depth of 60 μm or more. Additionally, the carbon portion 4 buried in the groove 2 works as a heat insulating portion having high heat insulation, and at the same time prevents the molten metal 11 from entering the groove 2.

As described above, according to the movable die 1 and the stationary die formed with a plurality of the grooves 2, the contact area with the molten metal 11 is so much reduced that the fluidity of the molten metal 11 can be improved by suppressing the heat dissipation of the molten metal 11.

Further, since the micro-grooves 5 are formed on the top surfaces of the ridge 3, the gas in the cavity can enter the micro-grooves 5 and form the air gap 12, thereby, the heat insulation can be further improved and the fluidity of the molten metal can be improved.

Further, in the embodiment, forming a plurality of the micro-grooves 5 on the top surface of the ridge 3 secures the strength of the ridge 3, as well as the gas is retained in the micro-grooves 5.

Figure 4:
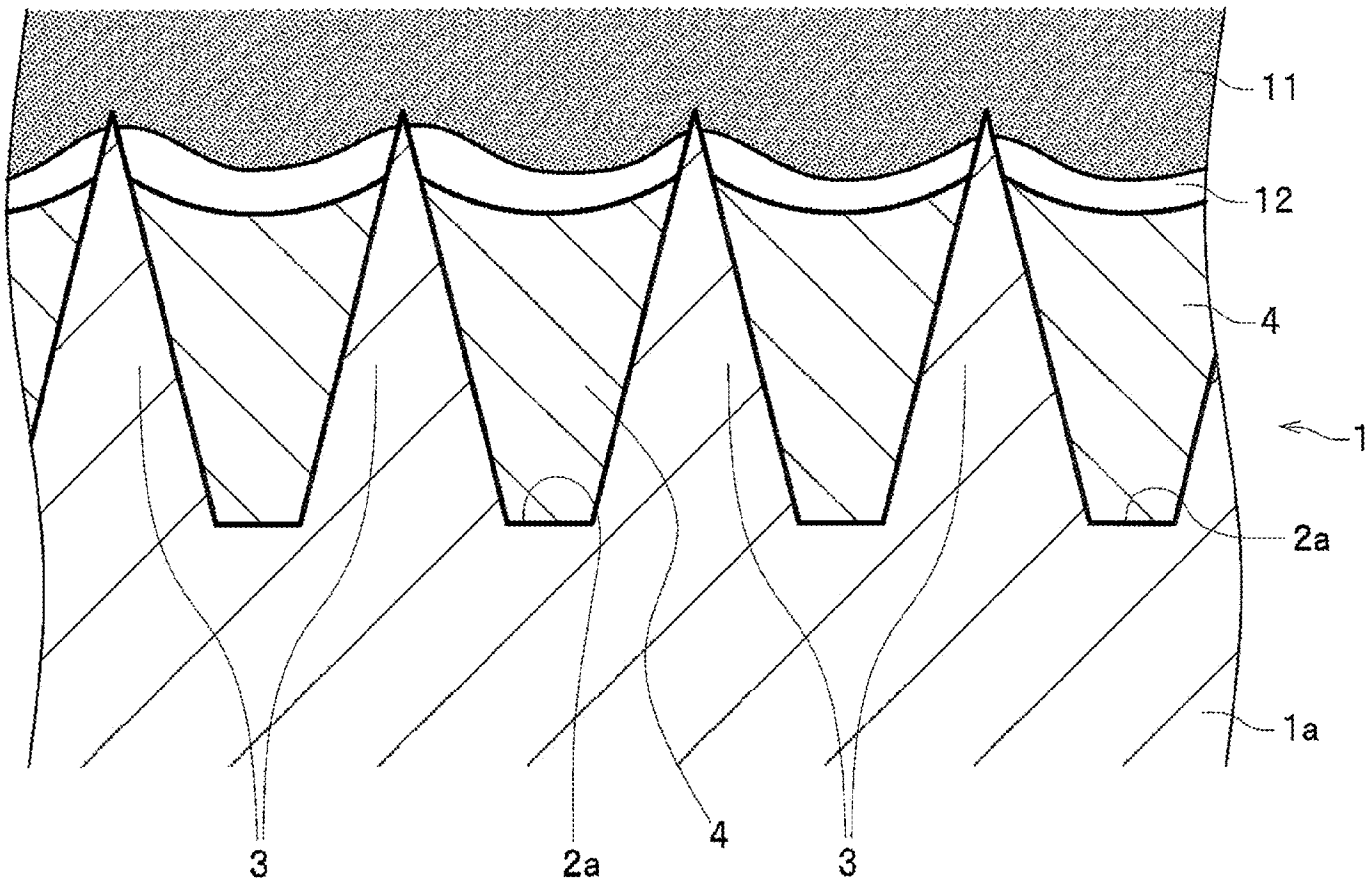
FIG. 4 is a cross-sectional view of a casting die as a comparative example for explaining an effect of the casting die according to the embodiment.

That is, in order to reduce the contact area of the ridges 3 with the molten metal 11, it can be considered to make a plurality of the ridges 3 having pinholder-like shape by making the ridge 3 like a triangular as viewed in the cross section and making it sharp the top surface of the ridge 3 (vertex) as shown in FIG. 4. Such a shape of the ridges, however, significantly lowers the strength of the ridges 3. Thus, as shown in the embodiment, forming a plurality of the micro-grooves 5 on the top surface of the ridge 3 reduces the possibility of lowering the strength of the ridge 3.

According to the coating technique with the carbon film including nano-carbon explained regarding the conventional technique, the film thickness control of the carbon film can change the fluidity, but cannot partially change the fluidity within a surface-treated area because the surface treatment is performed uniformly using an atmosphere of the gas.

On the other hand, according to the embodiment, since forming the grooves 2 and performing the carbon film complex nitriding can form the carbon portions 4, changing the lengths and the extending directions of the groove 2 allows easy changing of the extending directions and the lengths of the carbon portions 4. Therefore, it is possible to design to vary the ratio of the ridges 3 and the carbon portions 4 per unit length of the molten metal and to vary the fluidity finely.

Further, the method of forming the grooves 2 and the micro-grooves 5 as described on the embodiment enables to suppress the number of scanning from increasing as well as to suppress the occurrence of the molten portion.

Embodiment 1

Now, the embodiment 1 of the present invention is described.

As Samples 1 to 30 shown in the table of FIG. 5, thirty casting dies were prepared, different from each other in the opening width L1 and the depth L2 of the groove 2. Here, Samples 1 to 13 are equivalent to the embodiment of the present invention, and Samples 14 to 30 are equivalent to the comparative example.

SKD61 was used for the die material 1*a* of Samples 1 to 30. The groove 2 was formed using a pulse laser device (TruMicro5250 made by TRUMPF Ltd.) and a pulse laser beam with the pulse width set to 10 psec. Note that micro-grooves 5 were not formed on the top surface of the ridge 3.

Then, by applying a carbon film complex nitriding on the surface of Samples 1 to 30, a carbon film was coated and a carbon-portion 4 was formed on the surface of Samples 1 to 30. Note that the carbon film complex nitriding covered also the top surface of the ridge 3 with the carbon film. The carbon film complex nitriding was performed using the Super-Multinite Process (made by NIHON TECHNO Co., Ltd.).

Next, testing shots were applied on Samples 1 to 30. Aluminum for die casting (ADC12 material) was used for the molten metal.

The condition of the testing shot was that plunger speed was 2 m/sec (runner speed is less than 18 m/sec), casting pressure 90 MPa, and the number of shots 30. Note that the casting pressure actually measured was 60 to 70 MPa.

Then, checking on whether or not the carbon portions 4 buried in the groove 2 were peeled was performed using a laser microscope. FIG. 5 shows the checking result.

In FIG. 5, a sample that was checked to be in a state of the carbon portion 4 being buried in the groove 2 is expressed as "Buried," a sample checked to be in a state of the carbon portion 4 being peeled from the groove 2 is expressed as "Peeled."

The checking method was visual checking of images acquired using the laser microscope (VK-9700 made by KEYENCE CORPORATION).

Typical examples of the embodiment are shown in FIG. 6 that shows the images of Samples 1 and 6 obtained by the laser microscope, and typical comparative examples are shown in FIG. 7 that shows images of Samples 14 and 17 obtained by the laser microscope.

Figure 6A:
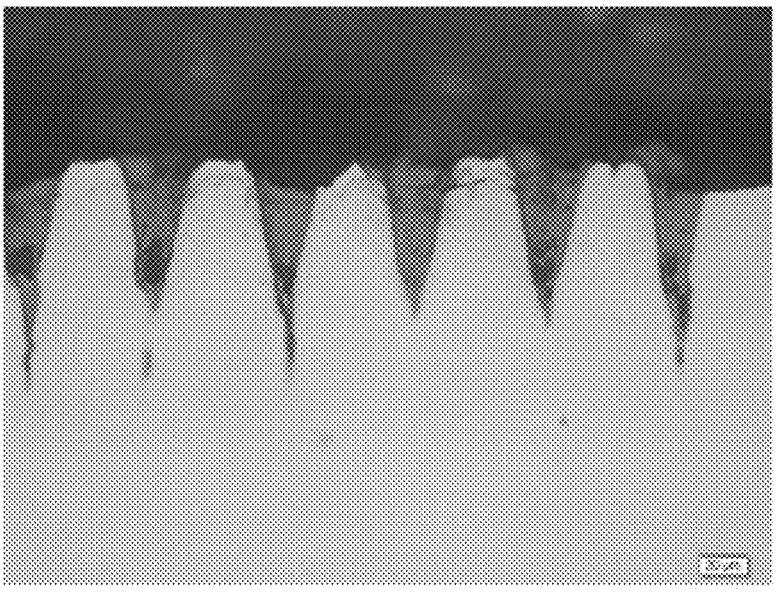
FIGS. 6A and 6B are photographs of a cross section of Embodiment 1.
Figure 6B:
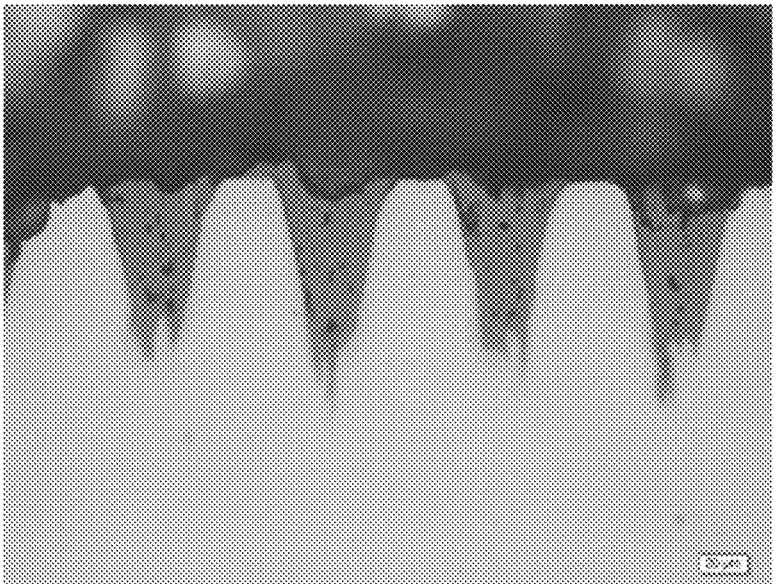

As shown in FIGS. 6A and 6B, Samples 1 and 6 were in a state in which the carbon portions 4 were buried in all of the grooves 2 even after testing shot.

Figure 7A:
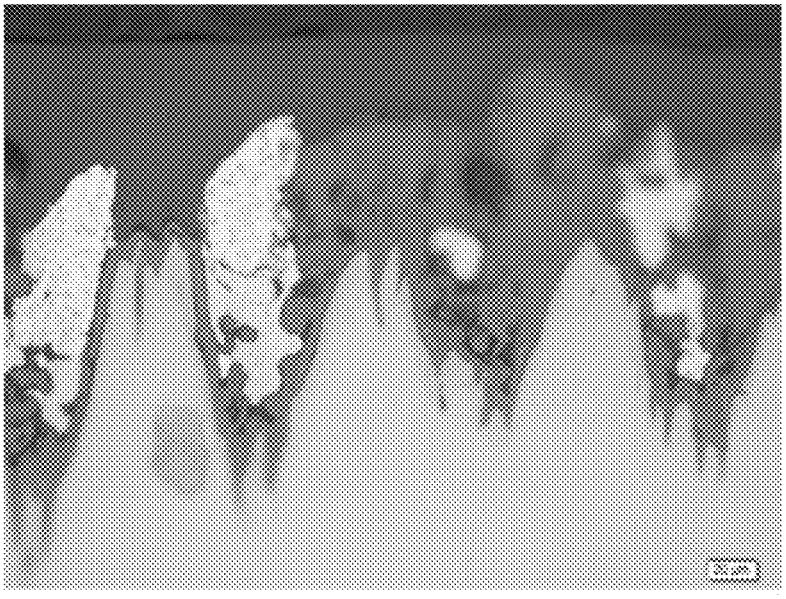
FIGS. 7A and 7B are photographs of a cross section of the comparative example.

On the other hand, as shown in FIG. 7A, Sample 14 was in a state in which aluminum entered into the grooves 2 and the carbon portions were peeled.

Figure 7B:
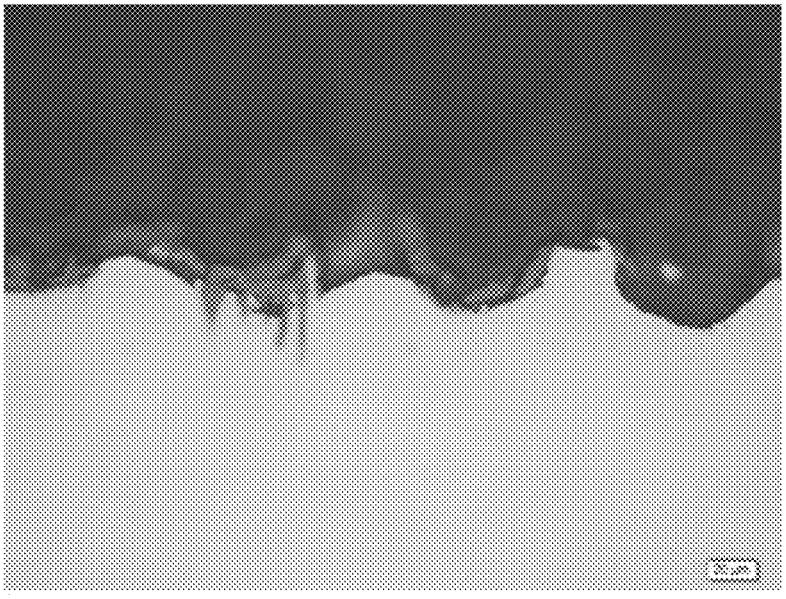

Further, as shown in FIG. 7B, Sample 17 was in a state in which the carbon portions buried in the grooves were perfectly peeled.

From the above result, it was confirmed that since the carbon portion 4 would not be peeled if buried in the groove 2 having an opening width of 45 μm or less and a depth of 60 μm or more, entering of the molten metal into the groove 2 can be prevented.

Embodiment 2

Next, a test was performed by a plurality of the irradiation steps, on the relationship between cumulative energy per unit area applied to the SKD material for the die material 1*a* (SKD61) and the depth of the grooves corresponding to the cumulative energy.

The irradiation conditions in Embodiment 2 were that the pulse width was 10 psec, the pulse fluence 0.5 to 3.0 J/cm$^2$, and the pulse lap ratio 70 to 85%.

The pulse laser device used was TruMicro5250 (made by TRUMPF Ltd. and wavelength: 515 nm; the same in Embodiments 3 and 4 described below.).

Figure 8:
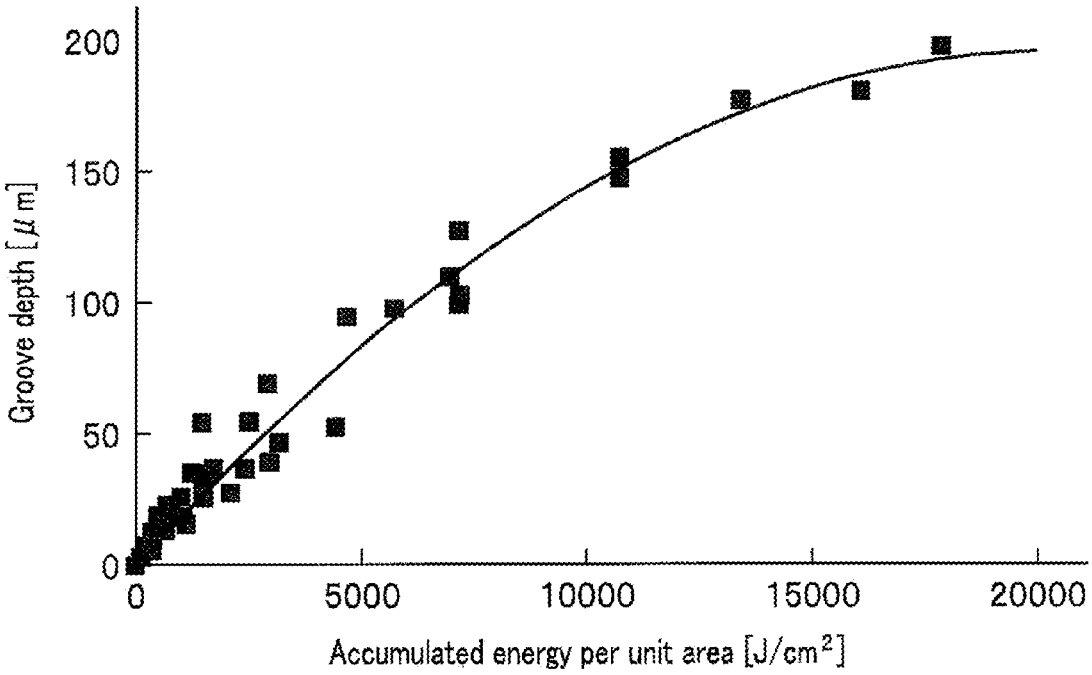
FIG. 8 is a graph showing a relationship between accumulated energy per unit area on which pulse laser is irradiated and measured depths of the groove, in the die material of Embodiment 2 (SKD material).

The method for measuring the depth of the groove was performed by a laser microscope. FIG. 8 shows the measurement results.

As shown in FIG. 8, it was confirmed that the depth of the groove formed became larger as the cumulative energy per unit area increased, i.e., as the number of the irradiation steps increased.

Embodiment 3

In Embodiment 3, Samples 31, 32, and 33 were prepared, formed with a plurality of grooves under respectively different irradiation conditions 1 to 3. Then, checking that each of the irradiation conditions 1 to 3 did not generate the molten portion and measurement of the groove depths were performed.

Additionally, for a comparative example, Sample 34 was prepared and formed with a plurality of grooves under an irradiation condition 4. Note that SKD61 was used for Samples 31 to 34.

Here, in the diagram showing the relationship between the pulse fluence and the pulse lap ratio shown in FIG. 3, the irradiation condition 1 falls within the zone G1, the irradiation condition 2 the zone EX, the irradiation condition 3 the zone G2, the irradiation condition 4 the zone NG. The specific conditions are shown in Table 1 below.

TABLE 1

| | Condition 1 (Example 3-1) | Condition 2 (Example 3-2) | Condition 3 (Example 3-3) | Condition 4 (Comparative) |
|---|---|---|---|---|
| Pulse fluence ($J/cm^2$) | 0.7 | 2.5 | 7.5 | 12 |
| Pulse lap ratio (%) | 26 | 85 | 48 | 82 |
| Number of scanning | 100 | 60 | 100 | 100 |
| Groove depth (entirety) (μm) | 8 | 30 | 35 | NA |
| Groove depth per scan (μm) | 0.08 | 0.5 | 0.35 | NA |

Figure 9:
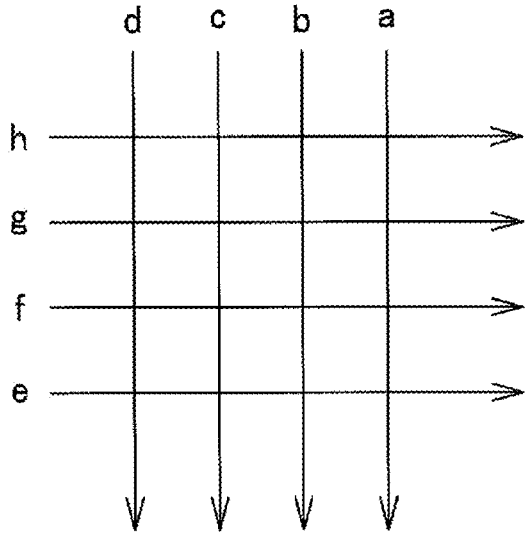
FIG. 9 is a diagram showing a direction and order of scanning of a pulse laser beam for forming lattice-shape grooves in Sample 32 of Embodiment 3.

In addition, Sample 32 was repeated with a plurality of the steps for scanning pulse laser beams in a grid pattern (scanned in the order of "a" to "h" shown in FIG. 9) and had grooves of grid pattern formed.

The method of checking whether or not the molten portions were generated was performed by determination by observing cross-sections of the grooves with the optical microscope and the groove surface with an SEM after cutting and etching the samples. FIGS. 10 to 13 show photographs of cross sectional views of the grooves and perspective views of the groove surfaces of Samples 31 to 34.

The measurement of the groove depths was performed by the laser microscope. Then, the groove depth formed in a single scanning was calculated. Table 1 shows the measured depth of the groove and the calculated depth of the groove per single scanning.

Figure 10A:
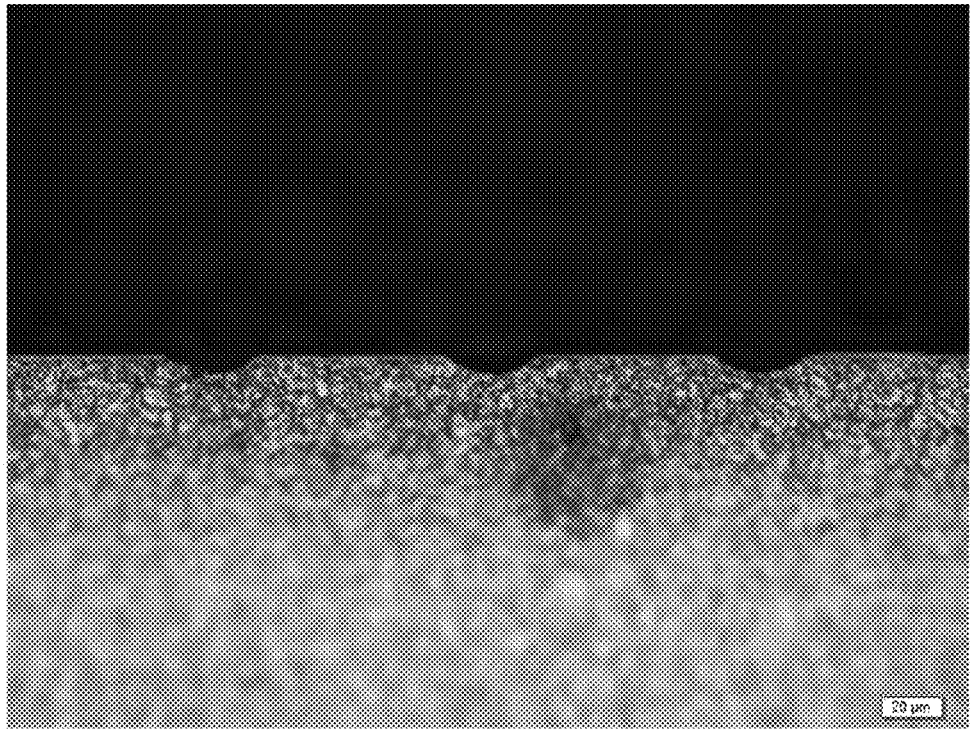
FIG. 10A is a photograph that shows a cross-sectional view of Sample 31 of Embodiment 3.
Figure 10B:
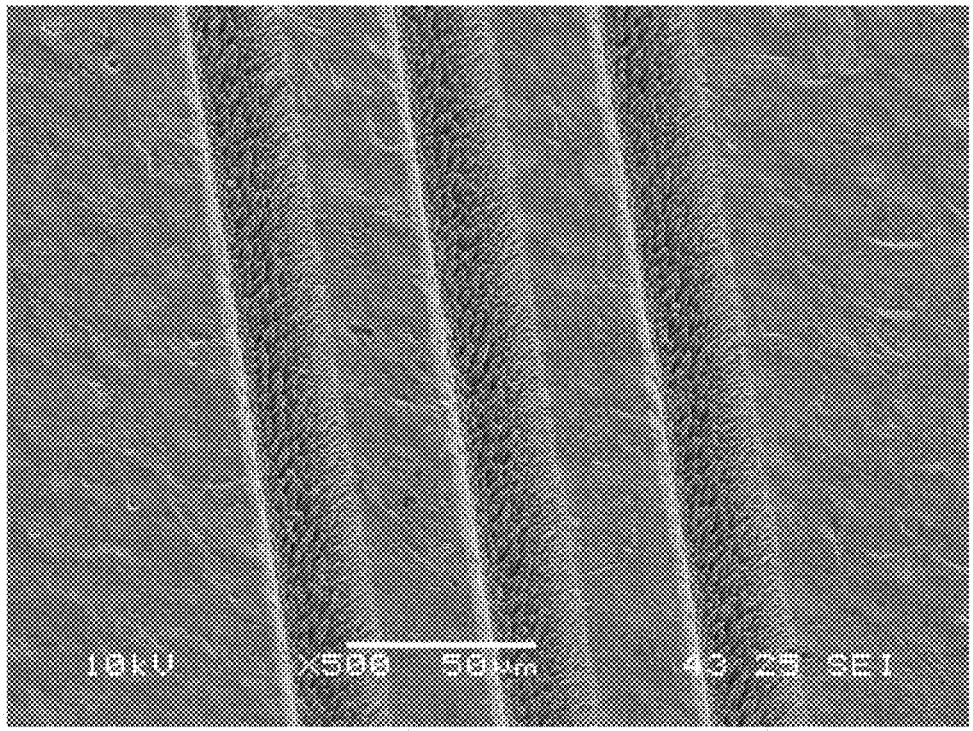
FIG. 10B is a photograph that shows a plan view of Sample 31 of Embodiment 3.
Figure 11A:
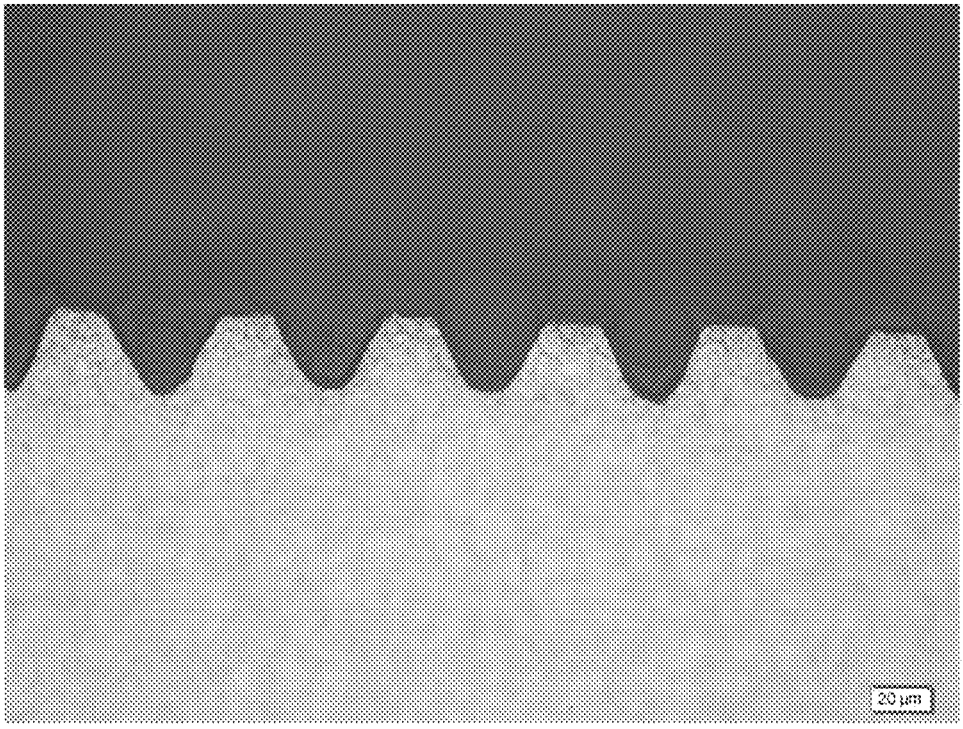
FIG. 11A is a photograph that shows a cross-sectional view of Sample 32 of Embodiment 3.
Figure 11B:
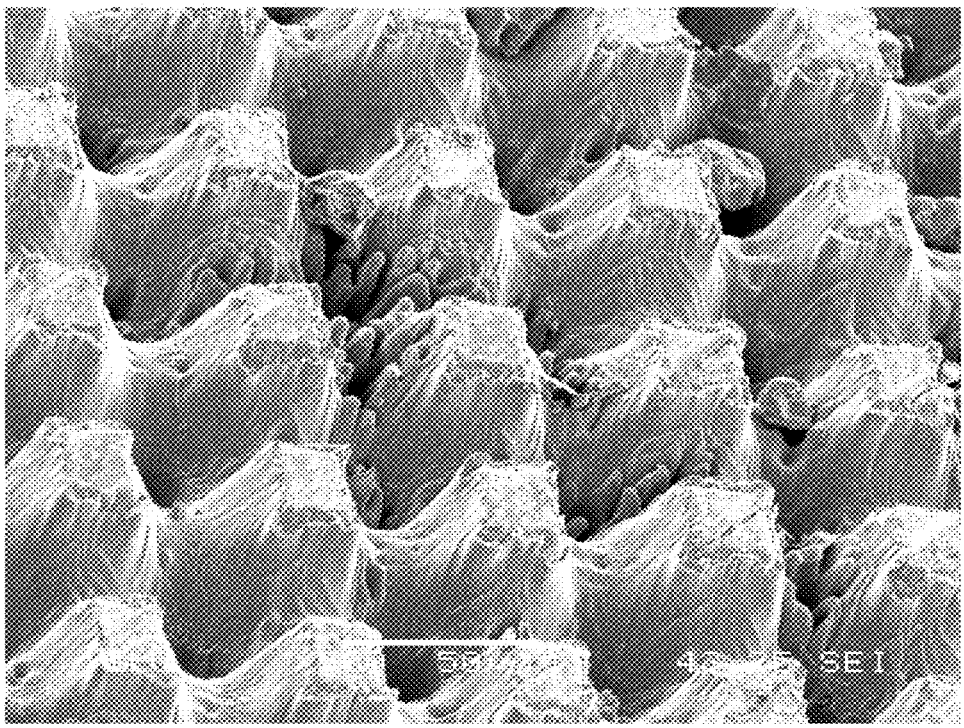
FIG. 11B is a photograph that shows a plan view of Sample 32 of Embodiment 3.
Figure 12A:
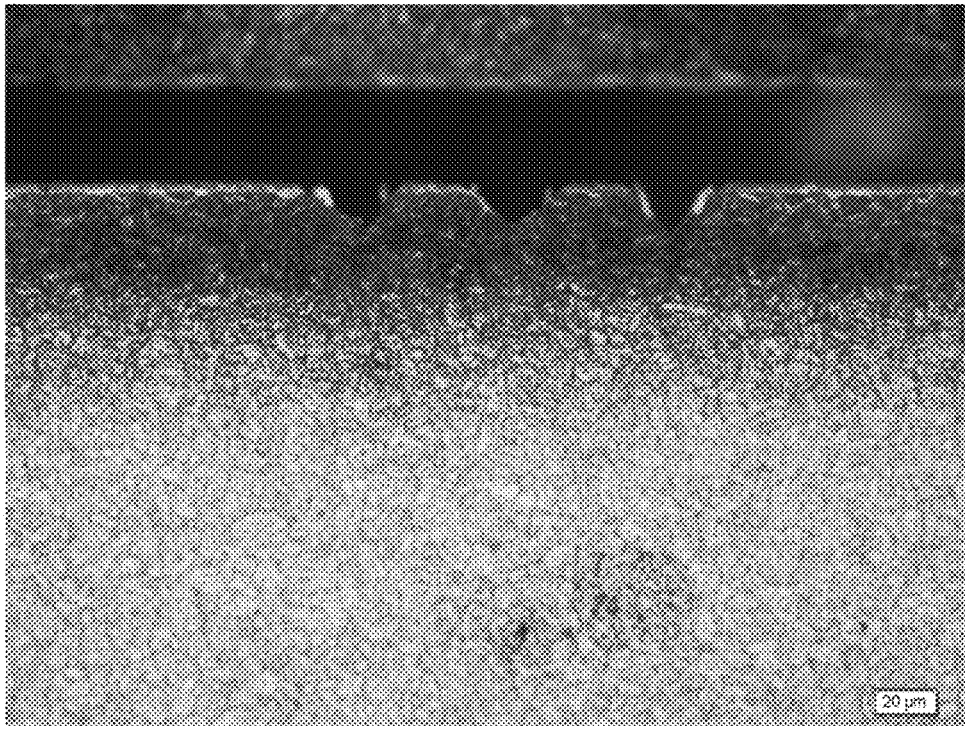
FIG. 12A is a photograph that shows a cross-sectional view of Sample 33 of Embodiment 3.
Figure 12B:
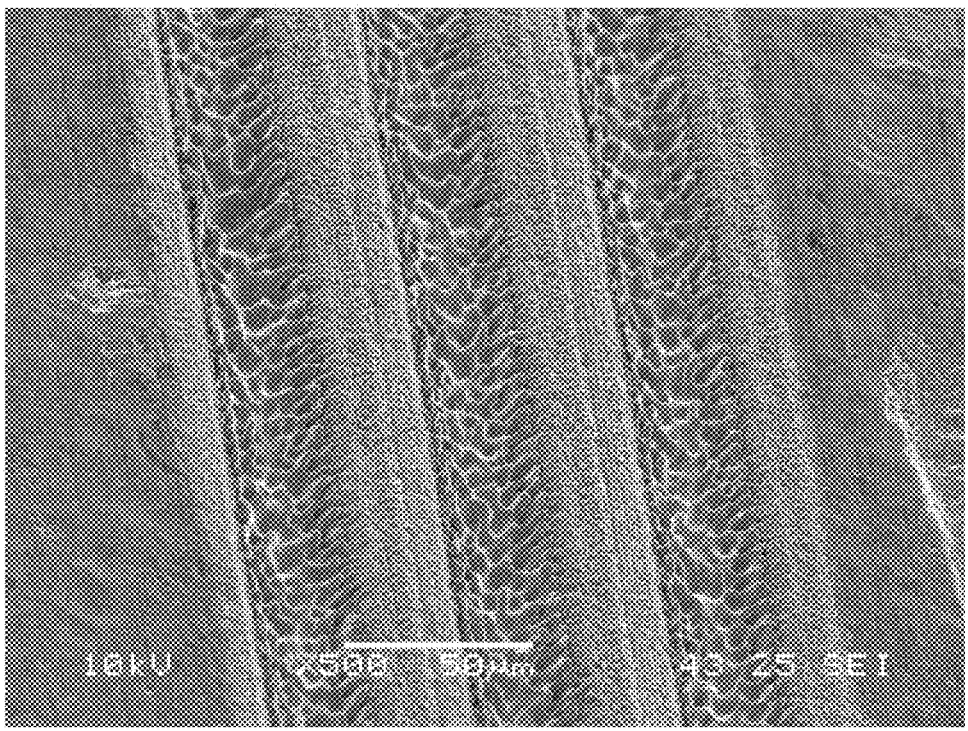
FIG. 12B is a photograph that shows a plan view of Sample 33 of Embodiment 3.

Considering the above result, as shown in FIGS. 10 to 12, the molten portion was not found in the vicinity of the grooves formed in Samples 31 to 33. Therefore, it was confirmed that the irradiation conditions 1 to 3 can form a groove having a desired depth without causing the molten portion to occur.

Figure 13A:
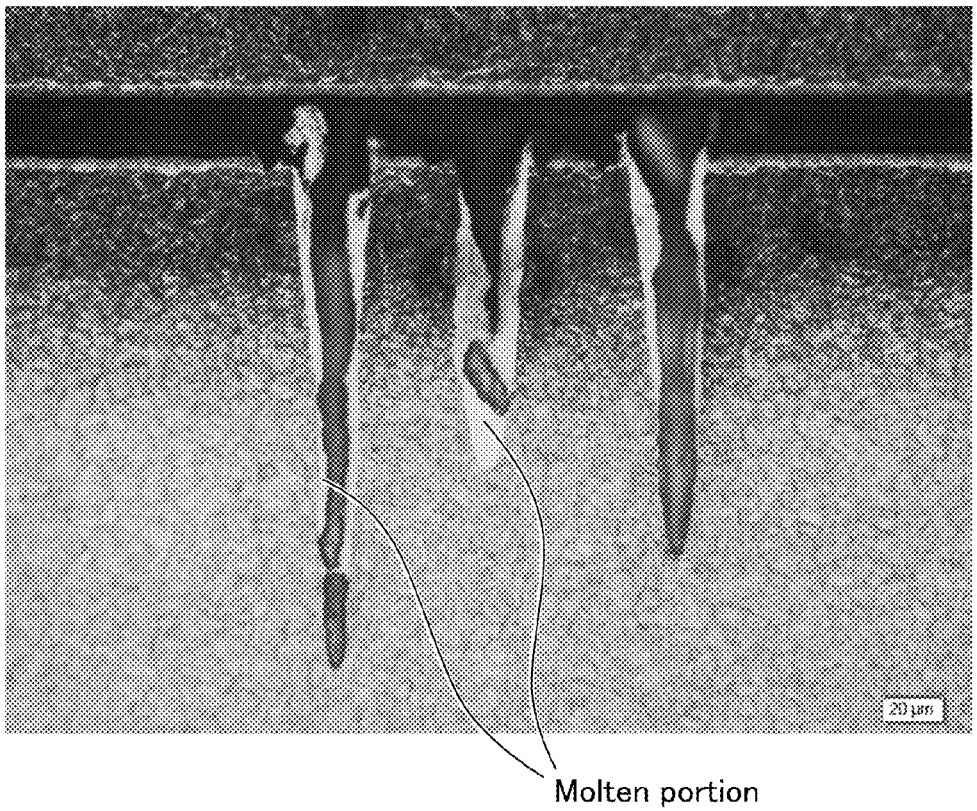
FIG. 13A is a photograph that shows a cross-sectional view of a Sample 34 of a comparative example.
Figure 13B:
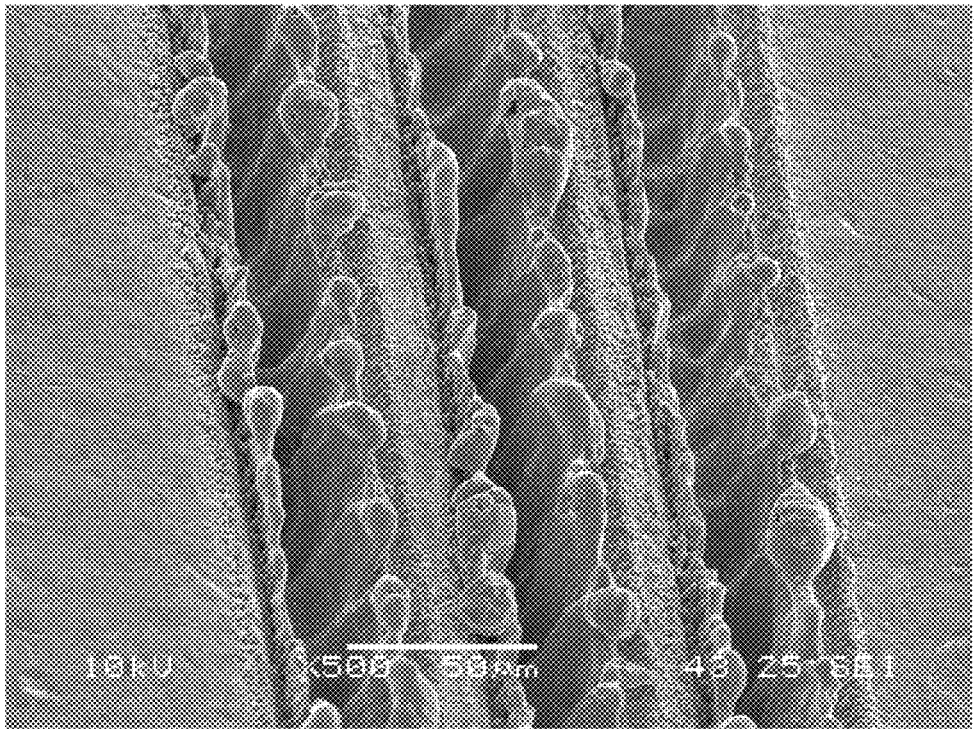
FIG. 13B is a photograph that shows a plan view of Sample 34 of the comparative example.

On the other hand, as shown in FIG. 13, a plurality of grooves formed on Sample 34 was found that the molten portion was generated around the groove by the thermal diffusion. Note that as shown in FIG. 13, a plurality of grooves formed on Sample 34 had respectively different depths and the depths thereof could not be measured.

Further, as shown in Table 1, it was confirmed that the irradiation condition 2 can form the deepest grooves (0.50 μm) by a single scan among the irradiation conditions 1 to 3 and that the irradiation condition 2 can form the grooves with the desired depth by the least number of scannings.

As shown in FIG. 10, FIG. 12, and Table 1, comparing the irradiation condition 1 with the irradiation condition 3, it was confirmed that the irradiation condition 3 can form deeper grooves than the irradiation condition 1, and that the higher pulse fluence and pulse lap ratio are preferable in order to form the deeper grooves.

On the other hand, as shown in FIGS. 10 and 12, comparing the groove surfaces of Samples 31 and 33, it was found that the unevenness occurred on the groove surfaces of Sample 33 and that the lower pulse fluence and pulse lap ratio are preferable in order to form a flat groove surface with little unevenness.

Embodiment 4

Figure 14:
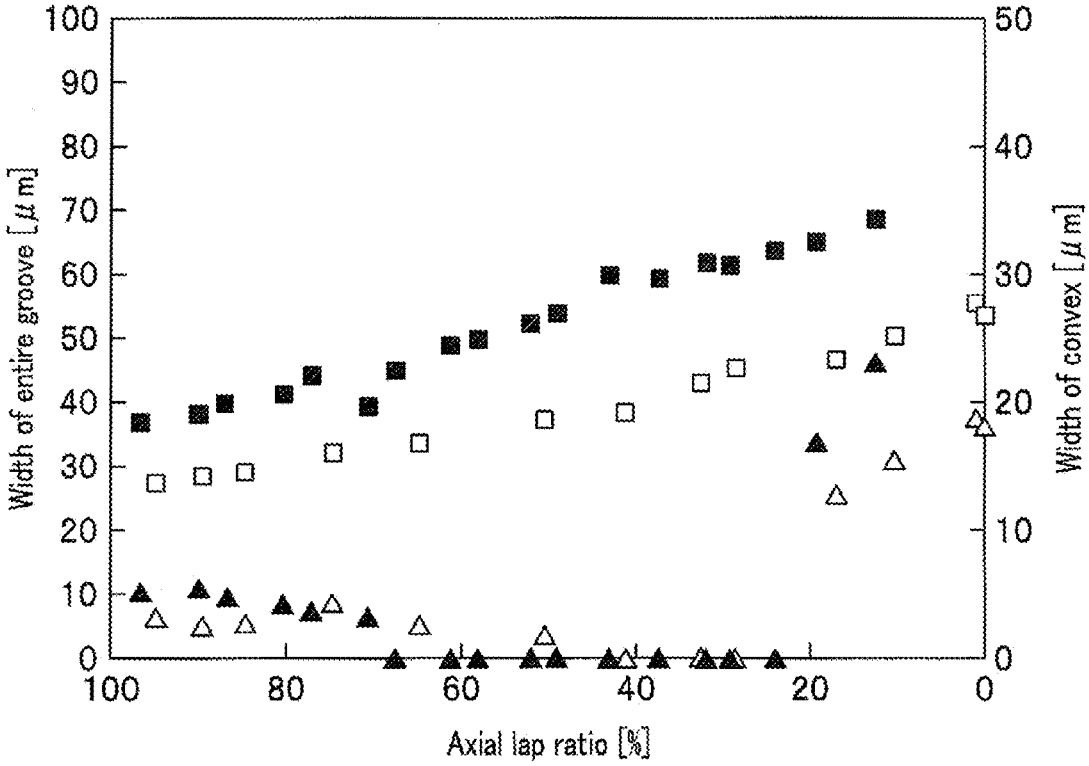
FIG. 14 is a graph showing a relationship between a measured width of the entirety of groove and a measured width of a ridge in a case of varying an axial lap ratio of Embodiment 4.

Embodiment 4 was prepared with a lens 1 (focal length F=163 mm) and a lens 2 (focal length F=255 mm). Then, forming grooves by varying the axial lap ratio in the range of 10% or more and 100% or less using the lens 1 and the lens 2 respectively, the width of the entire groove and the width of the protruding portion formed on the bottom surface of the groove were measured. FIG. 14 shows the measurement results.

Figure 15A:
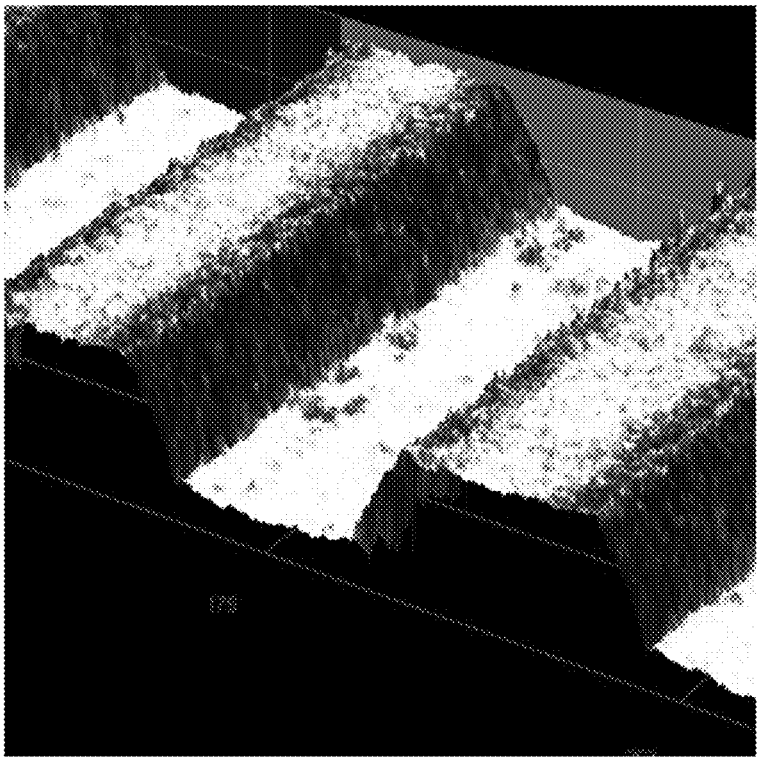
FIG. 15A is a photograph that shows a perspective view of a groove having a plane bottom surface in Embodiment 4.

FIG. 15A shows, as a typical example of cases in which the bottom surface of the groove is flat, a photograph obtained by perspective view of the grooves of SKD61 processed with 20% of the axial lap ratio using the lens 2.

Figure 15B:
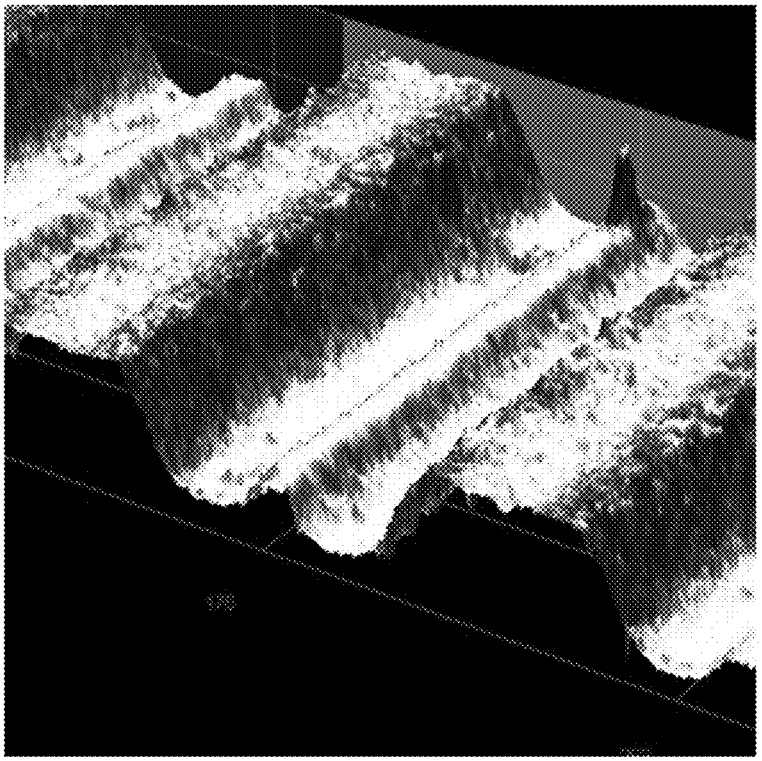
FIG. 15B is a photograph that shows a perspective view of a groove having a bottom formed with ridges in Embodiment 4.

In contrast, FIG. 15B shows, as a typical example of cases in which the bottom surface of the groove had the protruding portions formed, a photograph obtained by perspective view of the groove of SKD61 processed with 8% of the axial lap ratio using the lens 2. Note that in FIG. 15B the protruding portion formed on the bottom surface of the groove is the range surrounded by a broken line.

As shown in FIG. 14, it was confirmed that even if the lens 1 and the lens 2 are used, as the axial lap ratio becomes smaller, in other words, as the distance of shifting the axis of the pulse laser beam in the perpendicular direction is larger, the width of the entire groove expands.

Further, it was confirmed that the protruding portion was not formed on the bottom surface of the groove in the case of using the lens 1 with the axial lap ratio of 20% or more and less than 50% and the case of using the lens 2 with the axial lap ratio of 20% or more and less than 65%. Further, in the case of using the lens 1 with the axial lap ratio of 50% or more and less than 100% and the case of using the lens 2 with the axial lap ratio of 65% or more and less than 100%, protruding portions with the width of 5 μm were found.

On the other hand, it was found that when using either of the lens 1 and 2 with the axial lap ratio of less than 20%, protruding portions with the width exceeding 10 μm were formed.

DESCRIPTION OF REFERENCE NUMERALS

1: movable die (casting die)
2: groove
3: ridge

4: carbon portion
5: micro-groove
11: molten metal
12: air gap

We claim:

1. A casting die applied with a laser machining and a coating of a carbon film on a die surface, the casting die comprising:

a plurality of grooves formed at a predetermined pitch by a first laser machining;

a plurality of ridges protruding between the plurality of grooves; and a plurality of carbon portions buried in the plurality of grooves by the coating of the carbon film, wherein molten metal flows on the die surface on which the ridges and the carbon portions are alternately formed, wherein the grooves have an opening width of 45 μm or less and a depth of 60 μm or more, and wherein the ridges have, on a top surface thereof, a plurality of micro-grooves for reducing a contact area with the molten metal, and the plurality of micro-grooves are applied with a second laser machining.

2. The casting die according to claim 1, wherein the predetermined pitch is equal to or less than 100 μm.

* * * * *